US005549518A

United States Patent [19]

Wang

[11] Patent Number: 5,549,518

[45] Date of Patent: Aug. 27, 1996

[54] GOLF BALL DISPENSING DEVICE WITH LIGHTLY-ACTUATED PIVOTAL TRACK

[76] Inventor: Austin Wang, c/o Hung Hsing Patent Service Center P.O. Box 55-1670, Taipei, Taiwan

[21] Appl. No.: 426,881

[22] Filed: Apr. 24, 1995

[51] Int. Cl.[6] ..... A63B 57/00

[52] U.S. Cl. ..... 473/137; 473/132

[58] Field of Search ..... 273/32.5, 33, 201, 273/35 R

[56] References Cited

U.S. PATENT DOCUMENTS

| | | | |
|---|---|---|---|
| 2,071,356 | 2/1937 | Pagett | 273/201 |
| 2,171,299 | 8/1939 | Beckett | 273/201 |
| 3,003,770 | 10/1961 | Jones | 273/201 |
| 3,738,662 | 6/1973 | Hodgin | 273/201 |
| 3,758,118 | 9/1973 | Willcox | 273/201 |
| 4,892,318 | 1/1990 | Jennings | 273/201 |
| 5,464,223 | 11/1995 | Dermott | 273/201 |

*Primary Examiner*—Steven B. Wong

[57] ABSTRACT

A golf ball dispensing device includes: a pivotal track pivotally mounted in and normally vertically erected on a housing by a pivot, a hopper fitted on the housing for loading golf balls into the housing, an unloading lever formed on a first side portion of the pivot of the pivotal track and a counterweight secured on a balancing lever formed on a second side portion of the pivot opposite to the unloading lever, and a trigger device pivotally mounted on the housing about the pivot, whereby upon a manual depression such as depressed by a golf club or driver on the trigger device to bias the unloading lever downwardly from the vertically erected position, a golf ball received on a concave portion on the rear end portion of the unloading lever will gravitationally roll down along the unloading lever to a tee to be struck by a golfer; and after discharging the golf ball from the unloading lever, the counterweight on the balancing lever will automatically restore the pivotal track vertically ready for a next teeing portion, without requiring an electric motor and power supply.

5 Claims, 5 Drawing Sheets

GOLF BALL DISPENSING DEVICE WITH LIGHTLY-ACTUATED PIVOTAL TRACK

BACKGROUND OF THE INVENTION

A conventional golf ball teeing machine includes a pivotal arm pivotally secured on a housing connectable with a magazine stored with golf balls in the magazine. A driving mechanism provided with an electric motor therein may be fixed in the teeing machine for lowering the pivotal lever for discharging a golf ball to a tee to be struck by a golfer. However, such an electrically operated teeing machine may have the following drawbacks:

1. An electric motor and power source is required for lowering or raising the pivotal lever to thereby increase installation cost and waste electric energy.

2. A switch should be distantly connected to the electric motor by a cable or cord to possibly influence the hitting of the golf ball since the switch may be struck by a golf club or driver and the cable or cord may be tangled by the club or golfer's foot.

3. Power supply would become a problem for energizing the motor especially for an outdoor golf practice or game. If a municipal power source is supplied to the machine, a long-distance cord is required to cause inconvenience for the connection of cord. If a battery is provided without power cord, battery recharging or replacement upon exhausting of battery power may still cause inconvenience for the golfer.

Other conventional teeing devices should be actuated for teeing the golf ball in a heavy way, still causing teeing inconvenience for a golfer.

SUMMARY OF THE INVENTION

The object of the present invention is to provide a golf ball dispensing device including: a pivotal track pivotally mounted in and normally vertically erected on a housing by a pivot, a hopper fitted on the housing for loading golf balls into the housing, an unloading lever formed on a first side portion of the pivot of the pivotal track and a counterweight secured on a balancing lever formed on a second side portion of the pivot opposite to the unloading lever, and a trigger device pivotally mounted on the housing about the pivot, whereby upon a manual depression such as depressed by a golf club or driver on the trigger device to bias the unloading lever downwardly from the vertically erected position, a golf ball received in a concave portion on the rear end portion of the unloading lever will gravitationally roll down along the unloading lever to a tee to be struck by a golfer; and after discharging the golf ball from be unloading lever, the counterweight on the balancing lever will automatically restore the pivotal track vertically ready for a next teeing portion, without requiring an electric motor and power supply.

DETAILED DESCRIPTION

Figure 1:
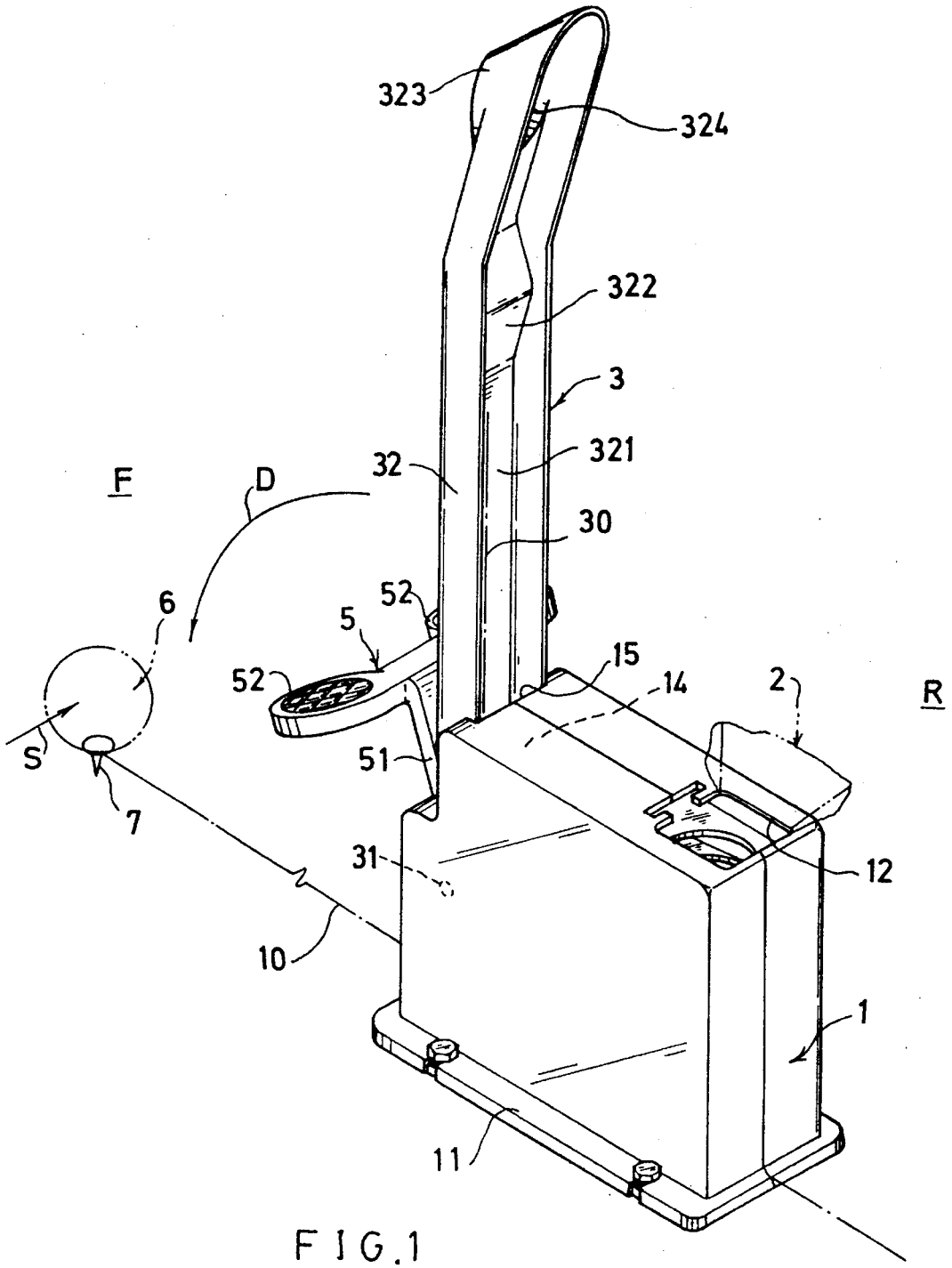
FIG. 1 is a perspective view of the present invention.
Figure 2:
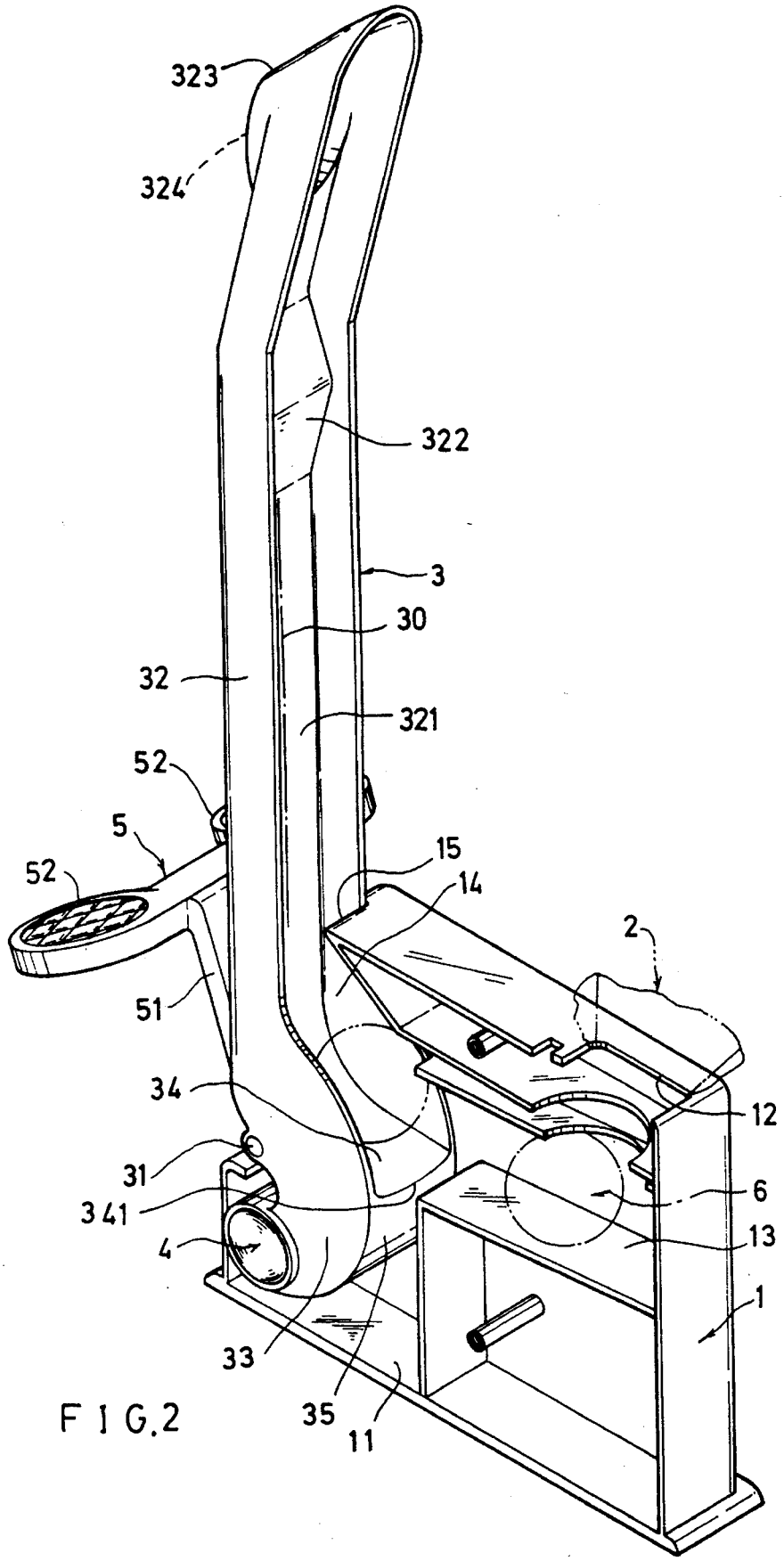
FIG. 2 is a partially cut-away illustration of the present invention.

As shown in the drawing figures, the present invention comprises: a housing 1, a hopper 2 for loading golf ball 6 into the housing 1, a pivotal track 3, a counterweight 4 mounted on the track 3, a trigger means 5 for biasing the pivotal track 3 downwardly inclinedly to gravitationally roll a golf ball 6 to a tee 7 on a mat 8 ready for a hit by a golfer.

The housing 1 includes: a base 11 securable on a mat 8, a golf course or a surface, a longitudinal axis 10 longitudinally defined at a central portion of the base 11, an entrance port 12 formed on an upper rear portion R of the housing for connecting a chute 21 of the hopper 2 for loading a plurality of golf balls 6 from the hopper 2 into a feeding channel 13 formed in the housing 1, a cavity 14 recessed in a front portion F of the housing 1 for pivotally mounting the pivotal track 3 in the front portion of the housing 1 around a pivot 31, a take-up opening **13*a* formed in the housing 1 between the cavity 14 and the feeding channel 13 for transferring a golf ball 6 into the pivotal track 3**.

Figure 3:
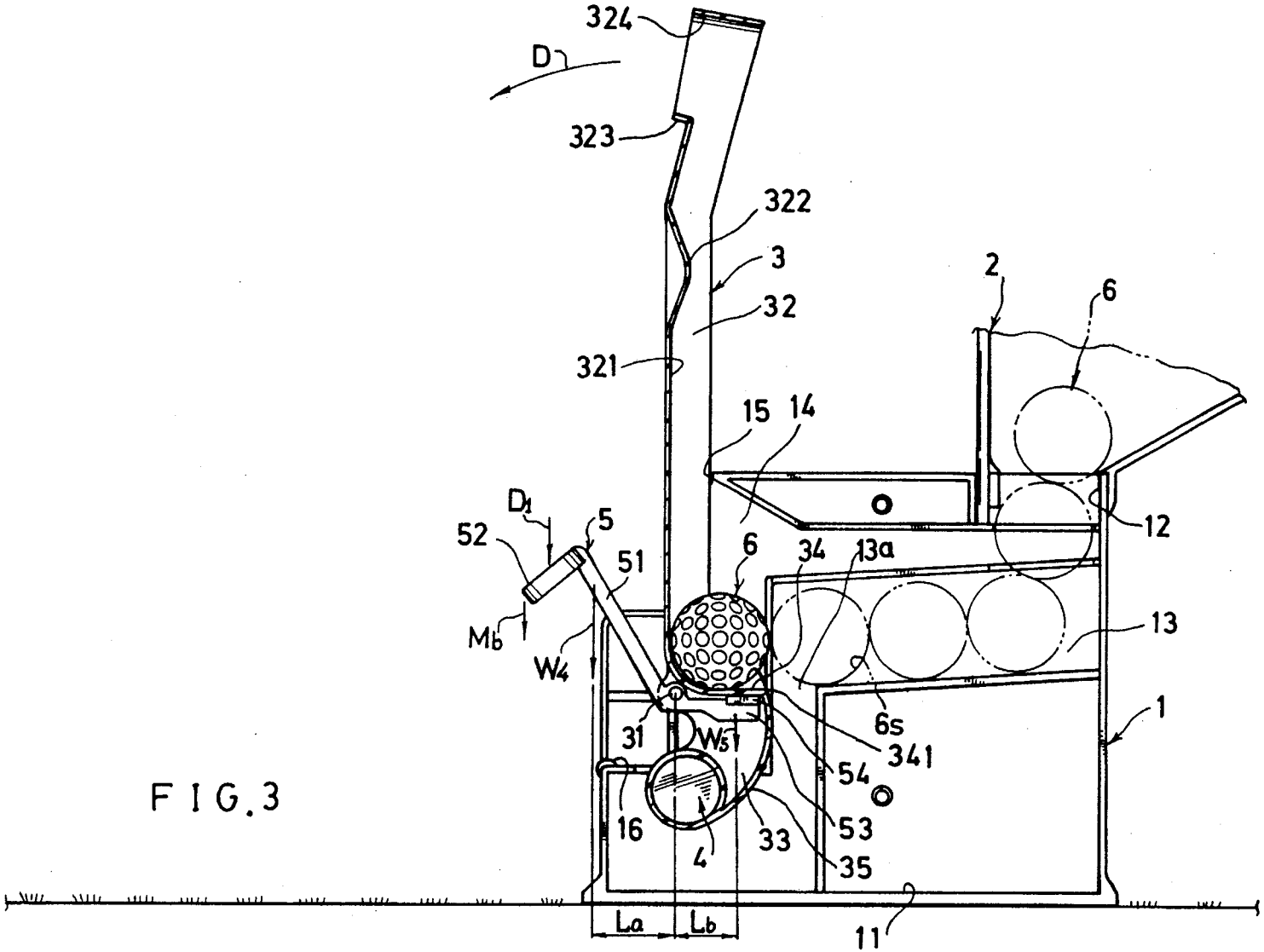
FIG. 3 is a sectional drawing of the present invention.

The pivotal track 3 includes: a pivot 31 secured in the cavity 14 in the housing 1, an unloading lever 32 formed on a first or front side portion of the pivot 31 of the track 3 and defining a track axis 30 at a longitudinal center of the unloading lever 32 with the track axis 30 generally aligned with the longitudinal axis 10 of the housing 1, a balancing lever 33 formed on a second or rear side portion of the pivot 31 for securing the counterweight 4 on a free end portion of the balancing lever 33 opposite to the unloading lever 32, a concave portion 34 formed on a rear and bottom end portion of the unloading lever 32 for receiving a golf ball 6 from the take-up opening **13*a* at the end of the feeding channel 13 in the housing 1 and having a depth of the concave portion 34 equal to a diameter of the golf ball 6 for precluding a standby golf ball 6*s* neighboring the golf ball 6 already received in the concave portion 34 as shown in FIG. 3, and an arcuate portion 35 formed on the balancing lever 33 between an outer edge portion 341 of the concave portion 34 and the counterweight 4. The arcuate portion 35 has a curvature arcuately convexly protruding towards the outer edge portion 341 of the concave portion 34 to be tangential to a standby golf ball 6*s* neighboring the golf ball 6 already received into the concave portion 34, whereby upon biasing of the unloading lever 32 downwardly (D) to raise the arcuate portion 35, the arcuate portion 35 will tangentially thrust (T) the neighboring standby golf ball 6*s* ready to be fed into the concave portion 34 as shown in FIG. 5 to retract (B) the neighboring ball 6*s* rearwardly to allow an unique golf ball 6 at each time to roll into the unloading lever 3. The unique golf ball 6 will then roll to be placed on the tee after biasing the unloading lever 32 downwardly (D) to define an acute angle A between the unloading lever 32 and the mat 8 as shown in FIG. 4**.

The unloading lever 32 includes: an elongate trough 321 longitudinally recessed in the unloading lever 32 adapted for rolling a golf ball 6 downwardly when biased downwardly about the pivot 31 towards a front side portion F of the housing 1, a convex portion 322 curved upwardly from a middle bottom portion of the trough 321 to slow down a rolling-down velocity of the golf ball 6 on the trough 321, a guiding sleeve 323 formed on an outermost end portion of the unloading lever 32 distal from the pivot 31, and a discharge opening 324 defined in the guiding sleeve 323 for discharging the golf ball 6 rolling from the trough 321 to the tee 7 positioned in a front portion of the housing 1 for a stroke by a golfer in a striking direction S generally perpendicular to the longitudinal axis 10 of the housing 1 as shown in FIG. 1.

Figure 4:
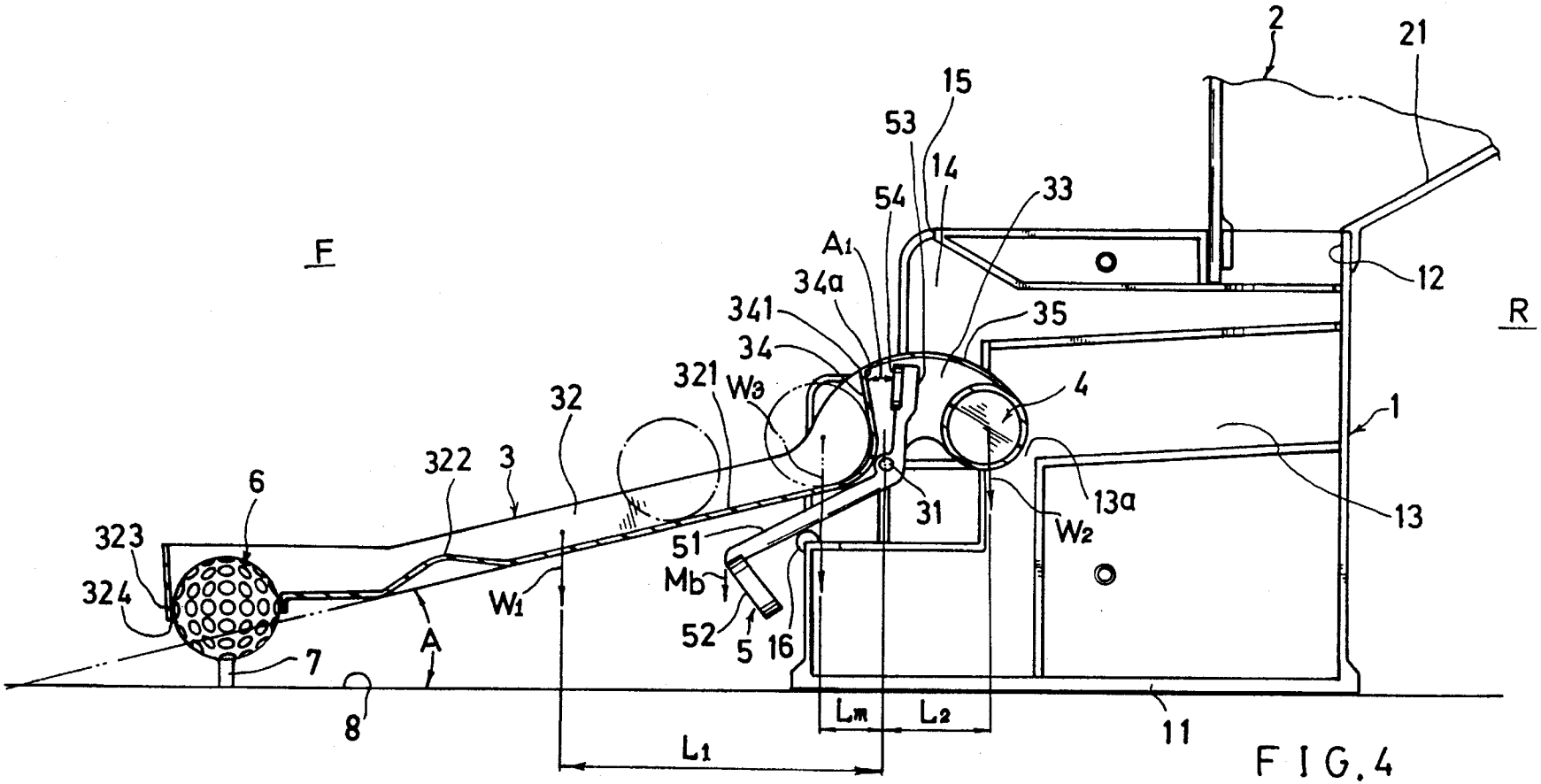
FIG. 4 is a sectional illustration showing a downward biasing of the pivotal track of the present invention.
Figure 5:
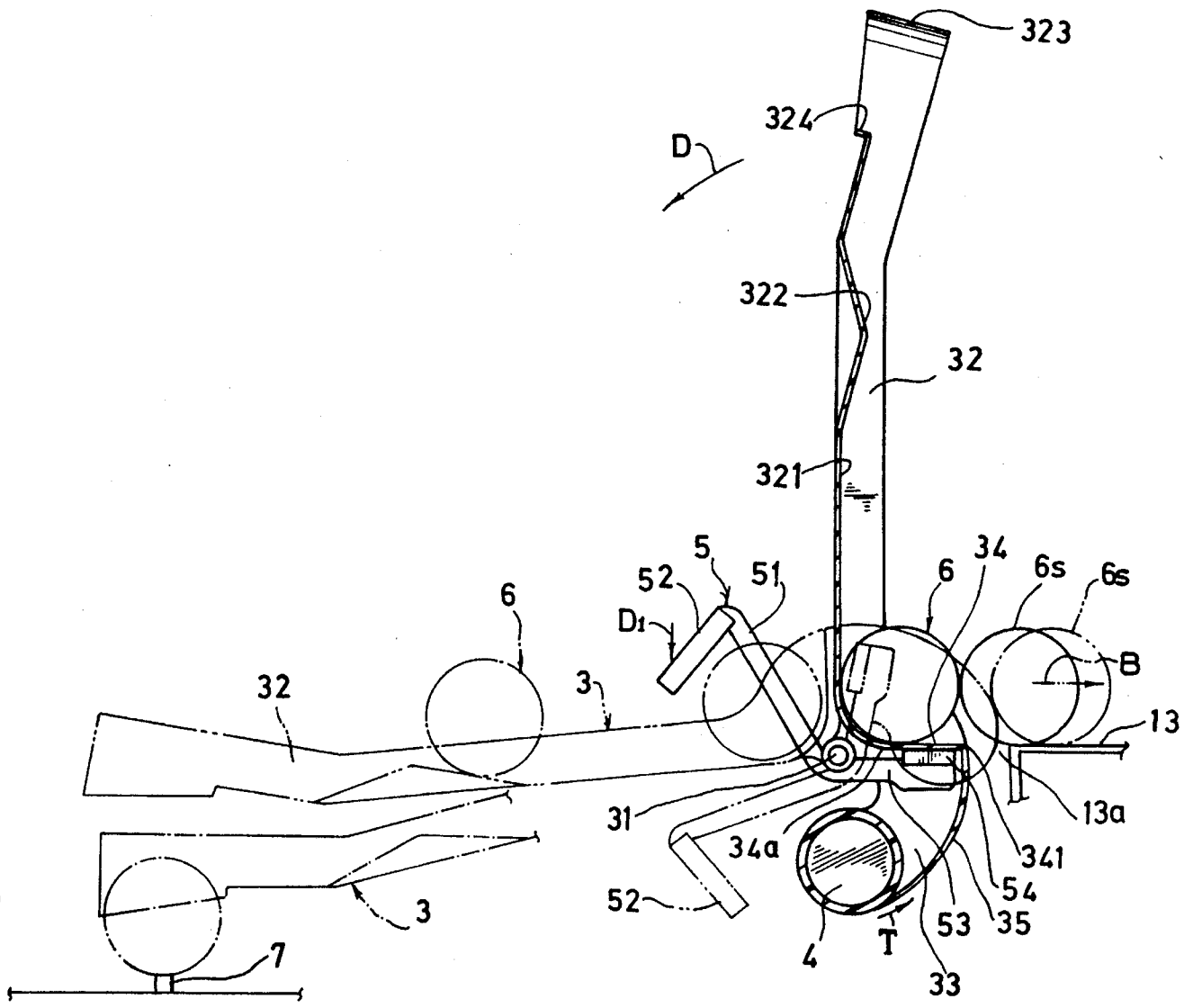
FIG. 5 is an illustration showing the biasing movement of the pivotal track of the present invention.

The concave portion 34 formed on a rear and bottom end portion of the unloading lever 32 is positioned at a first or front side portion of the pivot 31 opposite to the balancing lever 33 and has a bottom 34*a* on a back side of the concave portion 34 to be struck by the trigger means 5 for biasing the unloading lever 32 downwardly (D) to roll the golf ball 6 on the tee 7 as shown in FIGS. 3, 4, 5.

The trigger means 5 includes: a biasing arm 51 linked with an impacting arm 53 and pivotally mounted on the housing 1 by the pivot 31 with the biasing arm 51 and the impacting arm 53 disposed on two opposite sides of the pivot 31, a pair of depressing members 52 secured on an outer end portion of the biasing arm 52 opposite to the impacting arm 53 with the two depressing members 52 symmetrically disposed on two opposite sides of the biasing arm 51 to be projectively perpendicular to the track axis 30, and an elastomer pad 54 coated on an outer surface of the impacting arm 53 to face the bottom 34*a* of the concave portion 34 on the unloading lever 32 for impacting the bottom 34*a* of the concave portion 34 of the unloading lever 32 when downwardly depressing (D1) the depressing members 52 such as by a golf club or driver for initiating a downward biasing movement (D) of the unloading lever 32 about the pivot 31 for rolling down a golf ball 6 received on the concave portion 34 to the tee 7.

As shown in FIG. 3, when the unloading lever 32 is vertically erected as cushioned by the upper shoulder portion 15 on the housing 1 to allow the gravity of the unloading lever 32 and the counterweight 4 to overcome a biasing movement Mb of the depressing members 52 and the biasing arm 51 of the trigger means 5, the impacting arm 53 coated with the elastomer pad 54 thereon will not be rotated as retarded by the bottom 34*a* of concave portion 32 to thereby raise the biasing arm 51 and depressing members 52 ready to be depressed (D1) as shown in FIG. 3. The weight of the depressing members 52 and the biasing arm 51 is designated as W4, a distance between a gravity center of the weight W4 and the pivot 31 is La; while the weight of the impacting arm 53 and the pad 54 is designated as W5 having a gravity center departed from the pivot 31 with a distance Lb. In order to facilitate a downward movement (D1) of the depressing members 52 to rotate the impacting arm 53 so as to rotate the unloading lever 32 downwardly (D) for rolling down the ball 6, a biasing moment Mb of the depressing members 52 may be obtained as per following equation:

$$W4 \times La > W5 \times Lb$$

$$Mb = (W4 \times La) - (W5 \times Lb)$$

When lowering the depressing members 52 to lean the biasing arm 52 on the lower shoulder portion 16 on the housing 1 as shown in FIG. 4, the impacting arm 53 and the pad 54 will keep an aperture A1 from the bottom 34*a* of the concave portion 34 of the unloading lever 32. Therefore, the impacting arm 53 and the pad 54 will not directly contact the bottom 34*a* of the concave portion 34 as spaced by the aperture A1 prevent a heavy impact on the concave portion 34 of the unloading lever 32, to thereby primarily slow down the rolling of ball 6 along the trough 321. The convex portion 322 on the trough 321 will secondarily slow down the rolling ball 6 to ensure a reliable smooth teeing operation by stably placing the ball on the tee 7.

If the weight of unloading lever 32 is designated as W1, the weight of ball 6 as W3, and the distance between the gravity center of the lever 32 and the pivot 31 is designated as L1, the minimum distance between the gravity center of the ball 6 and the pivot 31 for initiating the ball 6 rolling down from the concave portion 34 designated as Lm; while the weight of the counterweight 4 plus the balancing lever 33 is designated as W2 having a gravity center departed from the pivot 31 with a distance of L2. Then, the following equation will be obtained:

$$(W1 \times L1 + W3 \times Lm) > W2 \times L2$$

Accordingly, the unloading lever 32 after being loaded with the ball 6 as held on the front side F of the pivot 31 will be automatically biased downwardly (D) to roll the ball 6 down to the tee 7 to overcome the weight W2 of the counterweight 4 and the balancing lever 33.

Then, for restoring the unloading lever 32 to be the vertical position as shown in FIG. 3, the "empty" unloading lever 32 after discharging the ball 6 through the discharge opening 324 will be restored clockwise by the counterweight 4 in accordance with the following equation:

$$W2 \times L2 > (W1 \times L1) + Mb$$

When returning the balancing lever 33 and the counterweight 4 from FIG. 4 to FIG. 3, the moment (W2×L2) of the lever 33 and counterweight 4 should be greater than the moment of unloading lever (W1×L1) and the biasing moment Mb of the trigger means 5 since the bottom 34*a* of the concave portion 34 should push the pad 54 and the impacting arm 53 backward to raise the biasing arm and depressing members 52 to be ready for next depression (D1) as shown in FIG. 3.

Conclusively, the equations are summarized as follows:

$$(W1 \times L1 + W3 \times Lm) > W2 \times L2$$

$$W2 \times L2 > (W1 \times L1) + Mb$$

Hence, $$(W1 \times L1 + W3 \times Lm) > (W1 \times L1) + Mb$$

After cancelling the W1×L1 on the two sides, $$W3 \times Lm > Mb$$

The present invention is superior to the conventional teeing machines or devices with the following advantages:

1. No electricity is required for dispensing the golf ball to a tee for saving energy and cost.

2. Lighter force is actuated for biasing the unloading lever downwardly for automatically rolling the golf ball down to the tee by merely actuating the trigger means 5. Once triggering to transcend the gravity center of the weights W1, W3 of the unloading lever 32 and the ball 6 beyond the pivot 31, the unloading lever 32 will then be stably inclined to automatically roll down the ball to accomplish the teeing operation without requiring a constant depression on the unloading lever 32 for a comfortable teeing.

3. Upon the downward biasing of the unloading lever 32, the arcuate portion 35 of the track 3 will automatically tangentially retract (B) the standby ball 6*s* as shown in FIG. 5 to enhance a smooth automatic ball dispensing operation.

The present invention may be modified without departing from the spirit and scope of this invention.

The hopper 2 may be modified to be other golf ball storage tanks or boxes, not limited in this invention.

I claim:

1. A golf ball dispensing device comprising: a housing having a feeding channel formed therein and having a hopper mounted on said housing for feeding a plurality of golf balls into said feeding channel in said housing, and having a longitudinal axis longitudinally defined at a central portion of said housing;

a pivotal track pivotally mounted in said housing and normally vertically erected on said housing for receiving a golf ball from the plurality of golf balls fed into said housing;

a counterweight mounted on a rear end portion of said pivotal track;

a tee positioned in front of said housing receiving the golf ball discharged from said pivotal track; and a trigger means pivotally mounted on said housing for biasing said pivotal track downwardly for rolling said golf ball down to said tee, whereby upon a manual actuation of said trigger means to rotatively bias the pivot track to gravitationally tilt the track to a downward inclined position for rolling said golf ball down to be discharged from a front end of said track to the tee; and upon discharge of the ball from said track, the counterweight will automatically restore the track vertically;

said pivotal track including: a pivot secured in a cavity recessed in the housing, an unloading lever formed on a first side portion of the pivot of the track and defining a track axis at a longitudinal center of the unloading lever with the track axis generally aligned with said longitudinal axis in the housing, a balancing lever formed on a second side portion of the pivot for securing the counterweight on a free end portion of the balancing lever opposite to the unloading lever, a concave portion formed on a rear and bottom end portion of the unloading lever for receiving one said golf ball from an take-up opening formed at the end of the feeding channel in the housing and having a depth of the concave portion equal to a diameter of the golf ball for receiving one said golf ball in said concave portion for precluding an entrance of a standby golf ball into said concave portion, with said standby golf ball neighboring the golf ball already received in the concave portion, and an arcuate portion formed on the balancing lever between an outer edge portion of the concave portion and the counterweight and said arcuate portion having a curvature arcuately convexly protruding towards the outer edge portion of the concave portion to be tangential to the standby golf ball neighboring the golf ball already received into the concave portion, whereby upon a biasing of the unloading lever downwardly to raise the arcuate portion, the arcuate portion will tangentially thrust the standby golf ball to retract the standby golf ball without entering the concave portion to allow an unique golf ball to roll at each time into the unloading lever to be placed on the tee when actuating said trigger means for downwardly inclinedly biasing the unloading lever towards said tee.

2. A golf ball dispensing device according to claim 1, wherein said unloading lever includes: an elongate trough longitudinally recessed in the unloading lever adapted for rolling said golf ball downwardly when said unloading lever is biased downwardly about the pivot towards said tee positioned at a front side of the housing, a convex portion curved upwardly from a middle bottom portion of the trough to slow down a rolling-down velocity of the golf ball on the trough, a guiding sleeve formed on an outermost end portion of the unloading lever distal from the pivot, and a discharge opening defined in the guiding sleeve for discharging the golf ball rolling from the trough to the tee positioned in a front portion of the housing for a stroke by a golfer in a striking direction generally perpendicular to the longitudinal axis of the housing.

3. A golf ball dispensing device according to claim 1, wherein said concave portion formed on a rear and bottom end portion of the unloading lever is positioned at a first side portion of the pivot opposite to the balancing lever and has a bottom on a back side of the concave portion operatively struck by the trigger means for biasing the unloading lever downwardly to roll the golf ball on the tee, said trigger means pivotally mounted in said housing about said pivot.

4. A golf ball dispensing device according to claim 3, wherein said trigger means includes: a biasing arm, an impacting arm linked with said biasing arm, with the biasing arm and the impacting arm disposed on two opposite sides of the pivot, a pair of depressing members laterally secured on an outer end portion of the biasing arm opposite to the impacting arm, and an elastomer pad coated on an outer surface of the impacting arm to face the bottom of the concave portion on the unloading lever for impacting the bottom of the concave portion of the unloading lever when downwardly depressing the depressing members for initiating a downward biasing movement of the unloading lever about the pivot for rolling down the golf ball received on the concave portion to the tee.

5. A golf dispensing device according to claim 1, wherein said unloading lever operatively defines a first moment W1×L1, when downwardly biased by said trigger means which has a biasing moment Mb for normally raising said trigger means ready for a depression thereon for triggering a downward biasing of said unloading lever, said biasing moment Mb of said trigger means obtained by: Mb= (W4×La)–(W5×Lb), wherein W4 is a weight of the depressing members and the biasing arm, La a distance between a gravity center of W4 and the pivot, W5 a weight of the impacting arm and the pad, and Lb is a distance between a gravity center of W5 and the pivot; and the first moment W1×L1 obtained by multiplying a first weight W1 of said unloading lever with a first distance L1 between a gravity center of the weight W1 and said pivot; said balancing lever defining a second moment W2×L2 by multiplying a second weight W2 of said counterweight plus the balancing lever and a second distance L2 between a gravity center of the weight W2 and the pivot; and said second moment, W2×L2, of said counterweight secured on said balancing lever being greater than said biasing moment Mb of said trigger means plus said first moment, W1×L1 as effected by said unloading lever when discharging the golf ball from said unloading lever to a tee, to satisfy:

$$W2 \times L2 > Mb + (W1 \times L1),$$

whereby after discharging said golf ball from said unloading lever to said tee, said counterweight will automatically restore said unloading lever vertically by overcoming said first moment of said unloading lever and said biasing moment Mb of said trigger means.

* * * * *